US011749918B2

(12) United States Patent
Hsiao et al.

(10) Patent No.: US 11,749,918 B2
(45) Date of Patent: Sep. 5, 2023

(54) CIRCUIT DEVICE

(71) Applicant: BIZLINK INTERNATIONAL CORP., New Taipei (TW)

(72) Inventors: Hsin-Tuan Hsiao, New Taipei (TW); Yi-Hsing Chung, New Taipei (TW); Ting-Jhen Pan, New Taipei (TW)

(73) Assignee: BIZLINK INTERNATIONAL CORP., New Taipei (TW)

( * ) Notice: Subject to any disclaimer, the term of this patent is extended or adjusted under 35 U.S.C. 154(b) by 46 days.

(21) Appl. No.: 17/383,624

(22) Filed: Jul. 23, 2021

(65) Prior Publication Data

US 2022/0037815 A1 Feb. 3, 2022

(30) Foreign Application Priority Data

Jul. 30, 2020 (TW) ..... 109209765

(51) Int. Cl.

| | |
|---|---|
| ***H01R 12/00*** | (2006.01) |
| ***H01R 12/53*** | (2011.01) |
| ***H01R 12/57*** | (2011.01) |
| *H01R 107/00* | (2006.01) |

(52) U.S. Cl.

CPC ..... *H01R 12/53* (2013.01); *H01R 12/57* (2013.01); *H01R 2107/00* (2013.01)

(58) Field of Classification Search

CPC ..... H01R 12/53; H01R 12/57; H01R 2107/00
USPC ..... 439/78
See application file for complete search history.

(56) References Cited

U.S. PATENT DOCUMENTS

| | | | | |
|---|---|---|---|---|
| 4,570,338 | A * | 2/1986 | Ignatowicz | H01R 12/53 439/876 |
| 6,497,581 | B2 * | 12/2002 | Slocum | H01R 12/57 439/83 |
| 7,556,543 | B2 * | 7/2009 | Weber | H01R 4/2454 439/857 |
| 9,136,641 | B2 * | 9/2015 | Bishop | H01R 12/718 |
| 9,161,436 | B2 * | 10/2015 | Havermann | H01R 13/6471 |
| 10,165,670 | B2 * | 12/2018 | Roan | H05K 1/0346 |
| 10,218,127 | B2 * | 2/2019 | Lee | H01R 24/60 |
| 10,498,057 | B2 * | 12/2019 | Ryu | H05K 9/0016 |
| 10,605,446 | B2 * | 3/2020 | Eckert | H01R 12/718 |
| 10,707,598 | B2 * | 7/2020 | Fu | H01R 12/515 |
| 10,741,941 | B2 * | 8/2020 | Wu | H01R 43/0256 |

(Continued)

FOREIGN PATENT DOCUMENTS

CN 101998766 A 3/2011

*Primary Examiner* — Harshad C Patel
*Assistant Examiner* — Vladimir Imas
(74) *Attorney, Agent, or Firm* — WPAT, P.C

(57) ABSTRACT

A contact pad is provided. The contact pad may be a strip-shaped component and forms at least one opening. A circuit device is also provided. The circuit device has a circuit board, at least one contact pad as mentioned above, and a cable. The contact pad is mounted on the circuit board as a connecting spot. The cable has at least one wire. The wire is mounted on the contact pad and covers the opening of the contact pad. An interval is formed in the opening and between the circuit board and the wire. With such structure, a capacitance formed between the wire and the circuit board may be the smallest and the impedance value may be the largest. Besides, the capacitance value can be adjusted via changing the material inside the interval or an area of the contact pad or the opening.

13 Claims, 11 Drawing Sheets

(56) References Cited

U.S. PATENT DOCUMENTS

| | | | | |
|---|---|---|---|---|
| 11,063,378 | B2 * | 7/2021 | Buchanan | H01R 12/53 |
| 11,228,123 | B2 * | 1/2022 | Ayzenberg | H01R 13/6592 |
| 11,336,040 | B2 * | 5/2022 | Fu | H05K 1/181 |
| 2010/0294530 | A1 * | 11/2010 | Atkinson | H01R 13/65914 174/78 |
| 2010/0294546 | A1 * | 11/2010 | Nickel | H01R 12/53 29/830 |
| 2014/0182885 | A1 * | 7/2014 | Gross | H01B 7/0861 174/117 F |
| 2018/0138639 | A1 * | 5/2018 | Lee | H01R 24/60 |
| 2019/0074623 | A1 * | 3/2019 | Sasayama | H01R 43/20 |
| 2019/0097331 | A1 * | 3/2019 | Smith | H01R 12/58 |
| 2020/0006898 | A1 * | 1/2020 | Yang | H01R 13/6471 |
| 2020/0335463 | A1 * | 10/2020 | Chen | H01L 24/08 439/78 |

* cited by examiner

CIRCUIT DEVICE

BACKGROUND OF THE INVENTION

1. Field of the Invention

The present invention relates to a circuit arrangement, especially to a signal transmission means on a circuit board.

2. Description of the Prior Arts

Nowadays, to connect a circuit board and a wire, a contact pad is mounted on the circuit board and then the wire is soldered on the contact pad. The soldered position is fixed via UV resin and a molding layer is formed in and covers the soldered position, which prevents the contact pad and the wire from being separated.

Since the wire and the circuit board are conductive, when the wire is soldered on the contact pad, the wire and the circuit board may be very close but do not contact. Therefore, a capacitance is formed between the wire and the circuit board and an impedance at the contact portion is changed. Though the capacitance can be decreased and the impedance can be increased via changing a thickness of the contact pad or a material of the contact pad and the wire, the amount of the capacitance that the existing methods can reduce is not enough. Besides, the capacitance may be increased further after the UV resin or other molding layer covers the soldered position. Therefore, the capacitance value and the impedance value of the end product are not ideal.

With the development of 5G communications, artificial intelligence, edge computing, and Internet of things devices, the frequency of signals will become higher and higher, and the transmission volume will become larger and larger. The contact portion of the circuit may influence the signal transmission very significantly. In the past, the frequency of the transmission is low, so a high capacitance value can be ignored in view of signal quality. However, as the frequency of the transmission is higher and higher now, high capacitance value becomes a problem.

To overcome the shortcomings, the present invention provides a contact pad and a circuit device with the contact pad to mitigate or obviate the aforementioned problems.

SUMMARY OF THE INVENTION

The main objective of the present invention is to provide a contact pad and a circuit device with the contact pad that can control capacitance value and impedance value beforehand in manufacture, so it is more flexible in design of the circuit device, and thus the circuit device may be suitable to 5G communications, artificial intelligence, edge computing, and Internet of things devices.

The circuit device has a circuit board, at least one said contact pad, and a cable. The contact pad is mounted on the circuit board as a connecting spot and electrically connected with the circuit board. The contact pad is strip-shaped and forms at least one opening. The cable has at least one wire. The wire is mounted on the contact pad and electrically connected with the contact pad. Each of the at least one wire covers the at least one opening of the at least one contact pad. At least one interval is formed in the at least one opening and between the circuit board and the at least one wire.

With the aforementioned structure, the interval is formed within the opening of each contact pad, the wire and the circuit board are spaced by the interval, and the air is inside the interval. Thus, a capacitance is formed between the wire and the circuit board, which increases the maximum possible impedance value. Besides, the capacitance value and the impedance value can be changed not only via disposing different materials in the interval, but also via using different dimensions or areas of the contact pad and the opening. Therefore, under the standard, the maximum possible impedance value can be further increased.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
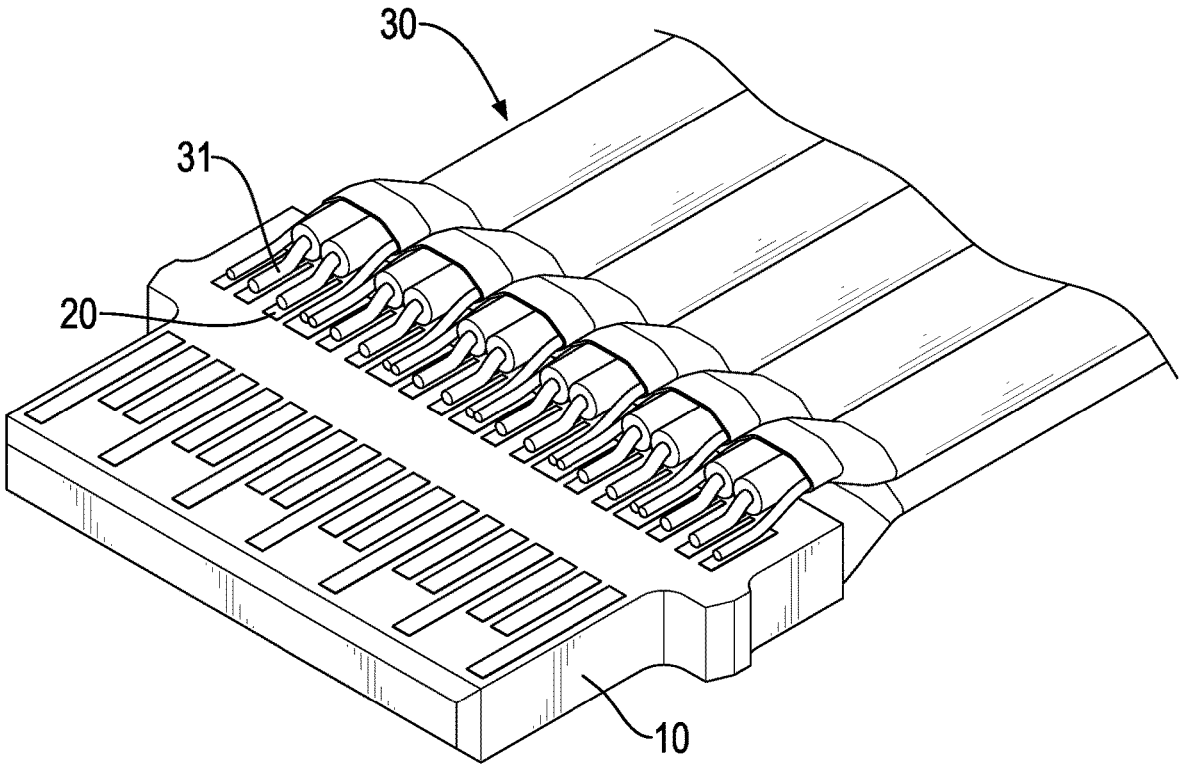
FIG. 1 is a perspective view of a circuit device in accordance with the present invention.
Figure 8:
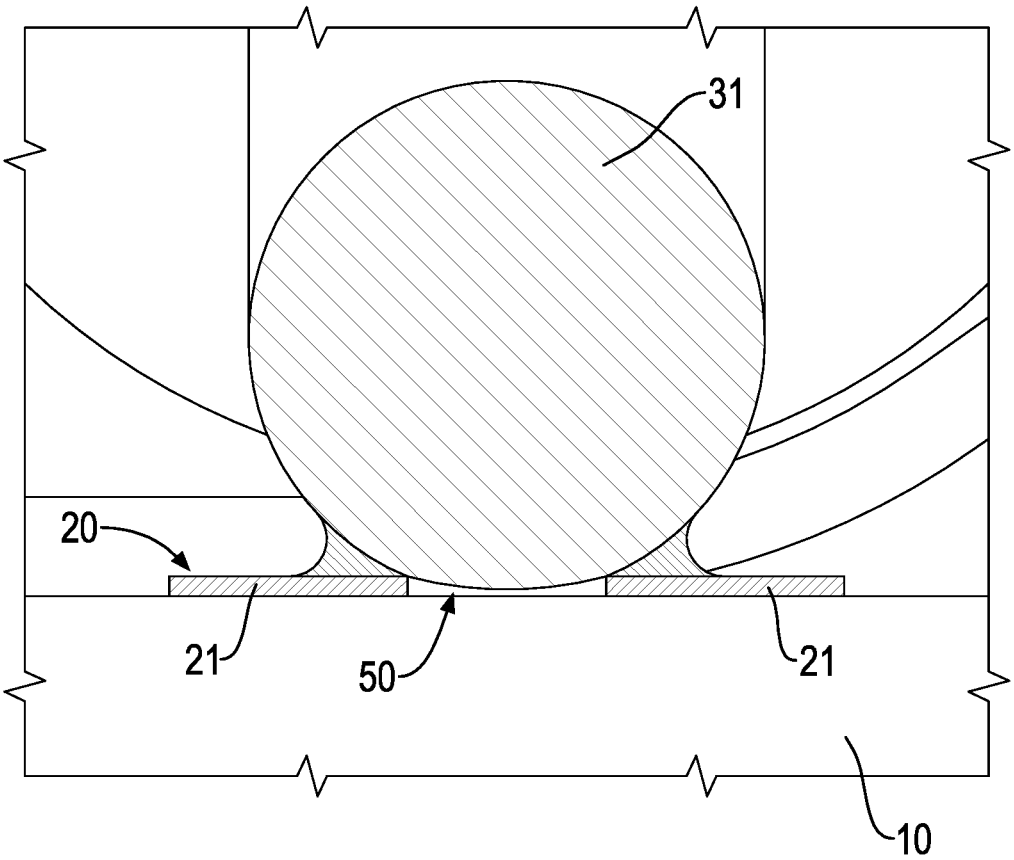
FIG. 8 is a sectional view of one of the contact pads and a round wire of the circuit device across line 8-8 in FIG. 3.
Figure 9:
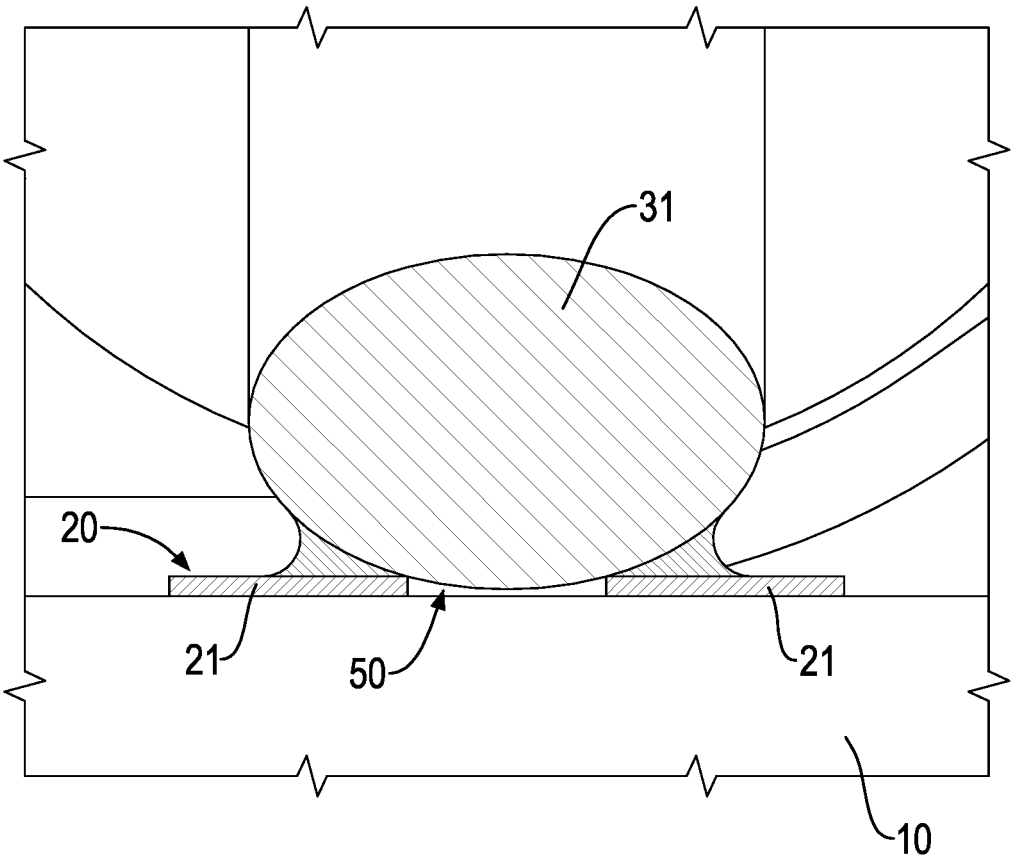
FIG. 9 is a sectional view of one of the contact pads and an oval wire of the circuit device in FIG. 3.
Figure 10:
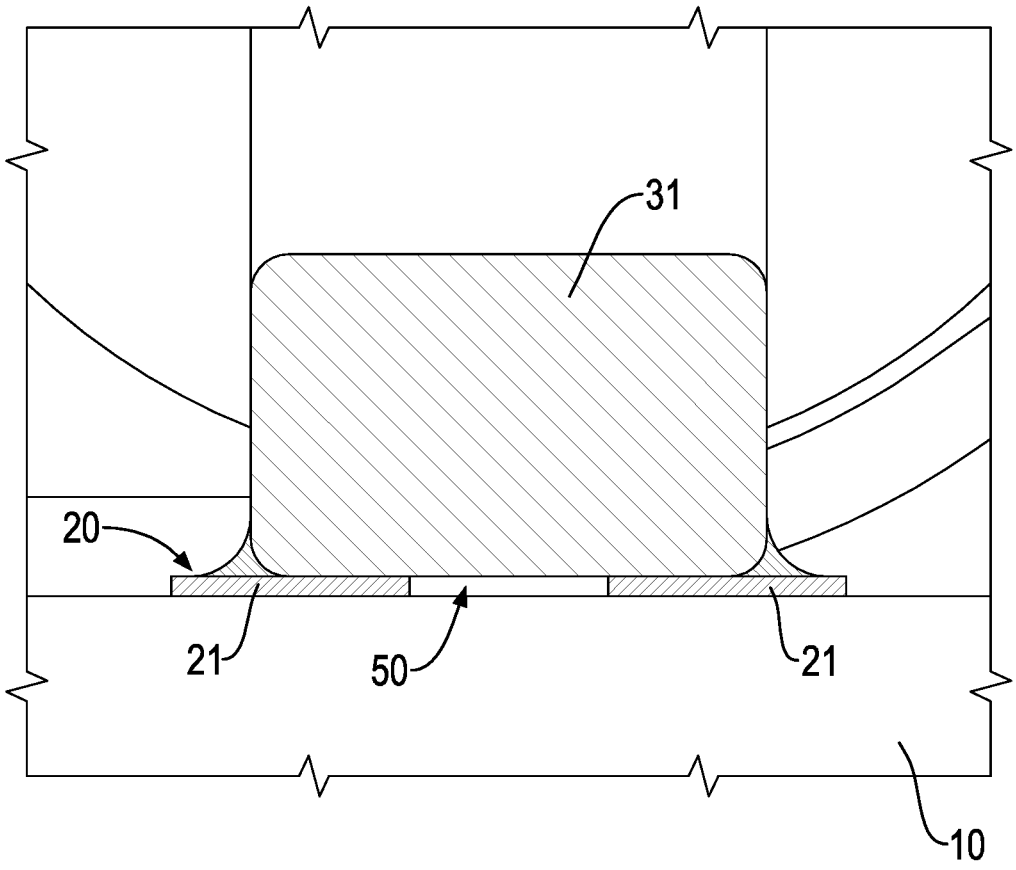
FIG. 10 is a sectional view of one of the contact pads and a rectangular wire of the circuit device in FIG. 3.
Figure 11:
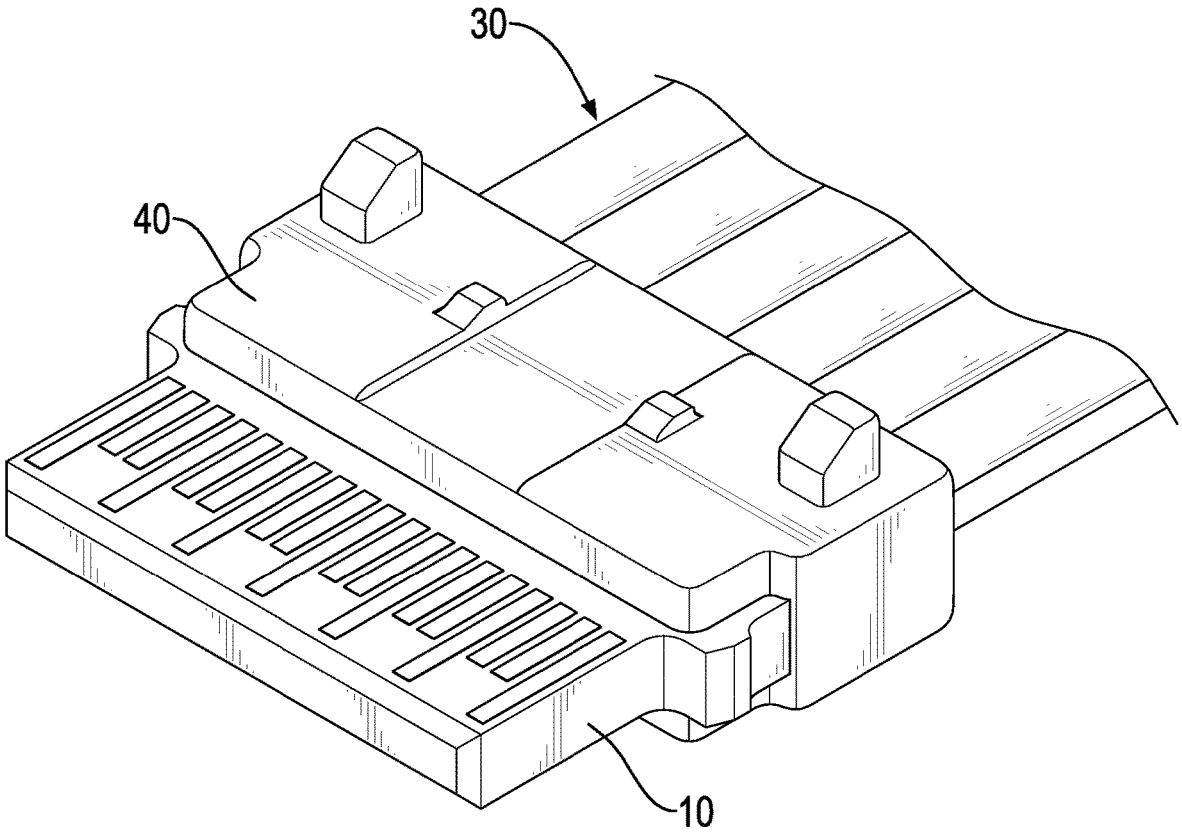
FIG. 11 is a perspective view of the circuit board and a shield layer of the circuit device in FIG. 1.

With reference to FIG. 1, FIG. 8, and FIG. 11, a circuit device is provided in accordance with the present invention. The circuit device may be any electronic device require wire-circuit board connection, for example, the circuit device maybe a connector or a component inside thereof. The circuit device comprises a circuit board 10, at least one contact pad 20 having opening 200 (hereinafter called as contact pad 20), and a cable 30, and may selectively comprise a shield layer 40. Moreover, the circuit device forms at least one interval 50.

Figure 2:
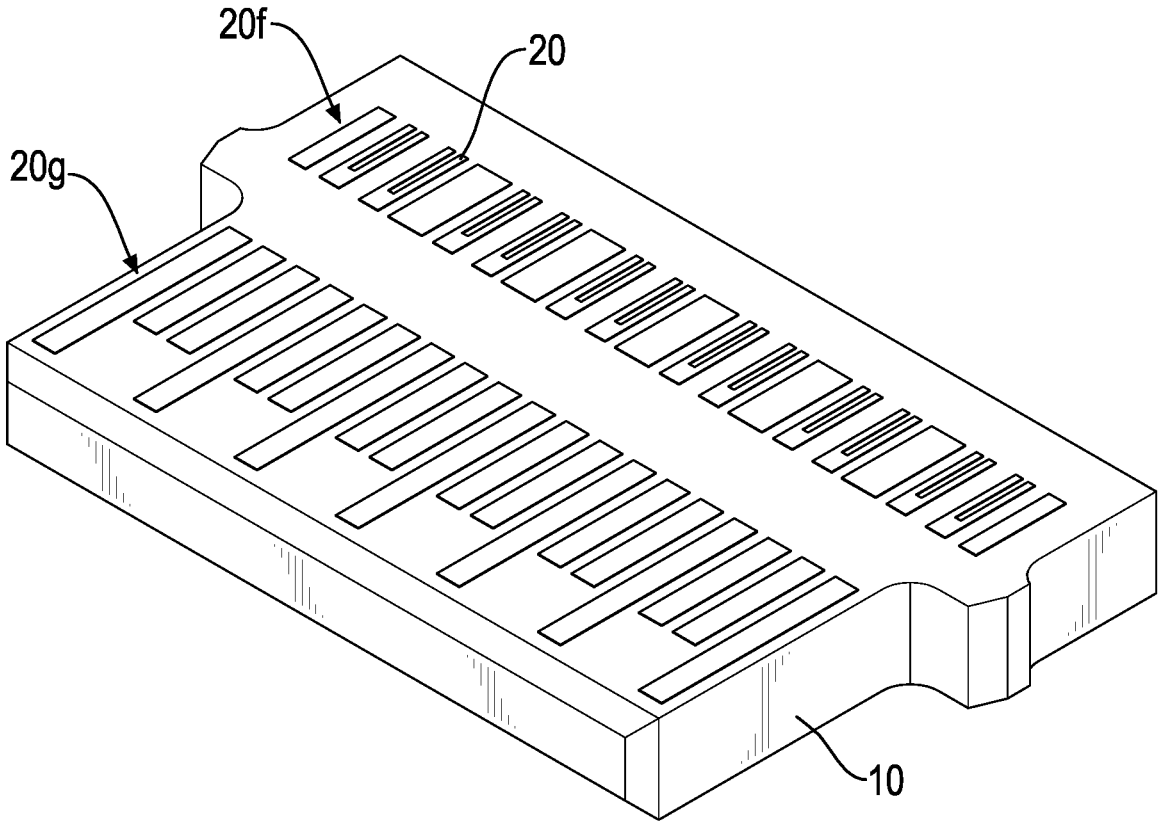
FIG. 2 is a perspective view of a circuit board and contact pads of the circuit device in FIG. 1.
Figure 3:
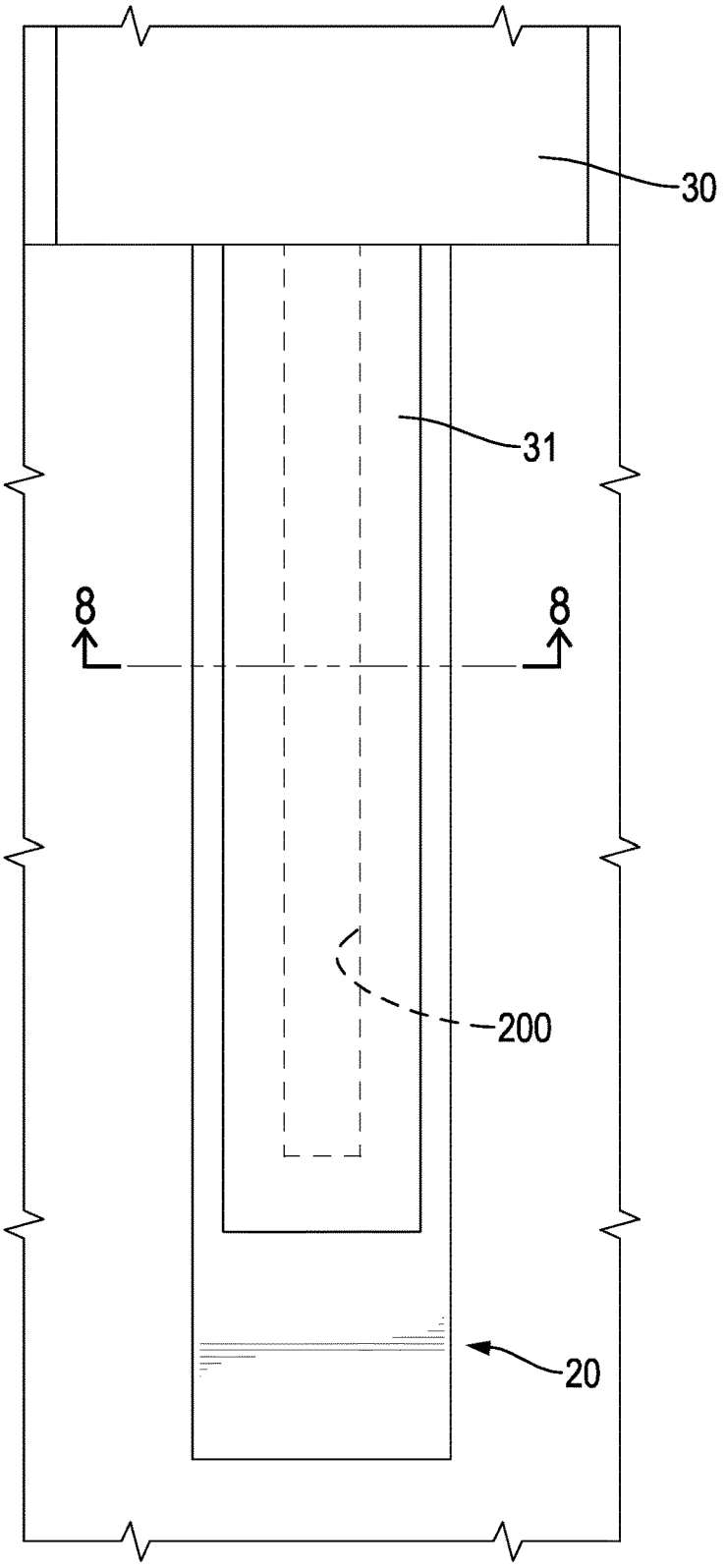
FIG. 3 is a top plane view of one of the contact pads and a cable of the circuit device in FIG. 1.
Figure 4:
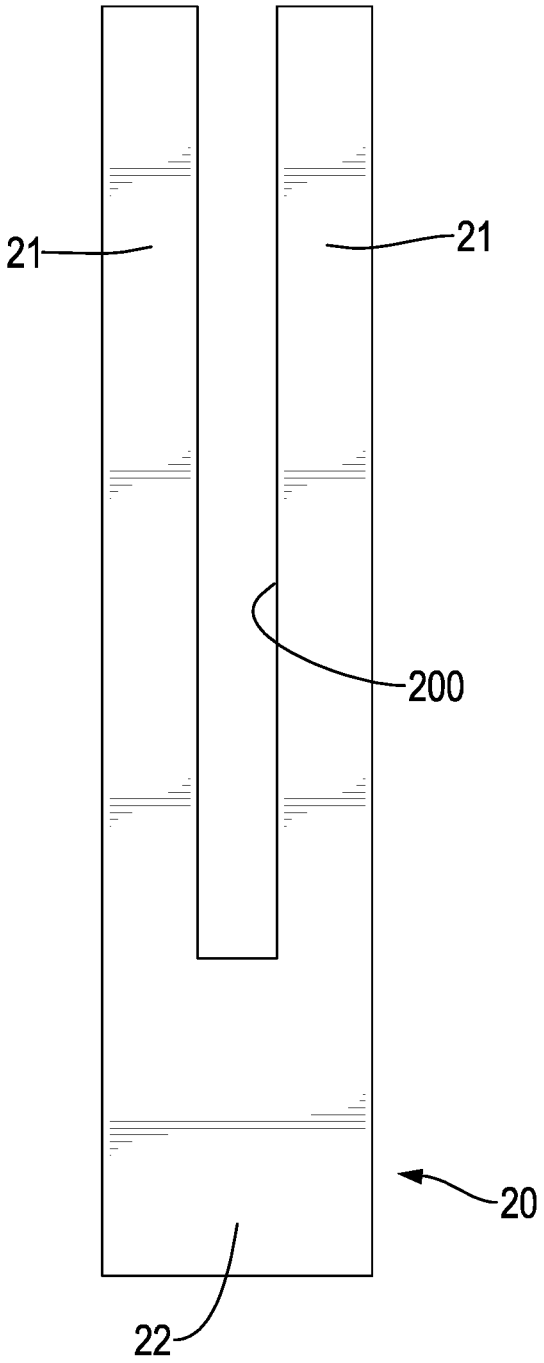
FIG. 4 is a schematic diagram of the contact pad in accordance with a first configuration of the circuit device in FIG. 1.

Then please refer to FIG. 2 to FIG. 4. The at least one contact pad 20 is mounted on the circuit board 10 and electrically connected with the circuit board 10. In this embodiment, there are multiple contact pads 20. Therefore, the contact pads 20 are adapted as connecting spots of the circuit board 10. Each of the contact pads 20 may be strip-shaped, or say, long narrow shaped, having at least one opening 200. Moreover, each of the contact pads 20 may be left-right symmetry and be one pieced formed.

In a first configuration, the contact pad 20 includes two elongated arm portions 21 and a connecting portion 22. The two elongated arm portions 21 are spaced apart from each other. Two ends of the connecting portion 22 are connected to the two elongated arm portions 21. Therefore, one opening 200 is formed between the two elongated arm portions 21 and the connecting portion 22. The two elongated arm portions are rectangle-shaped respectively and being parallel to each other. In other words, in the first configuration, each of the contact pads 20 comprises one opening 200. Precisely, each of the elongated arm portions 21 comprises a first end and a second end opposite each other and two ends of the connecting portion 22 are respectively connected to the first end of the two elongated arm portions 21. Therefore, the opening 200 is formed between the two elongated arm portions 21 and the connecting portion 22. In other words, each contact pad 20 is U-shaped, or say, the contact pad portion comprises at least a U-shaped portion. Each contract pad 20 has one non-enclosed (open ended) opening 20.

Figure 5:
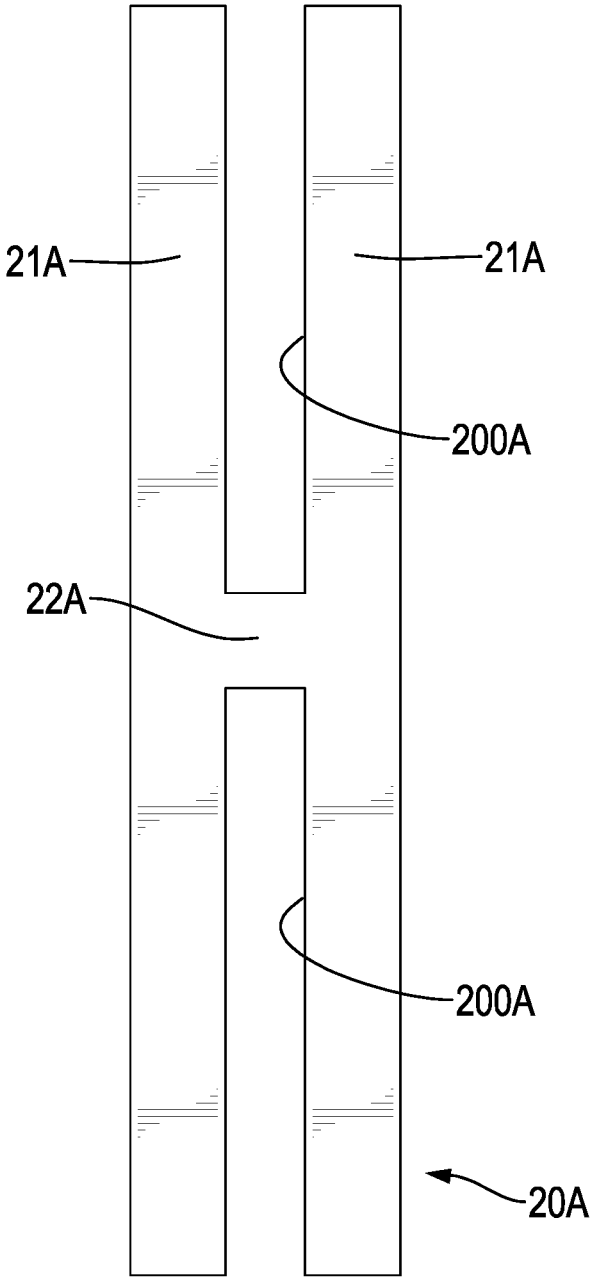
FIG. 5 is a schematic diagram of the contact pad in accordance with a second configuration of the circuit device in FIG. 1.

Then please refer to FIG. 5. In a second configuration of the contact pad 20A, it may include two elongated arm portions 21A and a connecting portion 22A. The two elongated arm portions 21A are spaced apart from each other and two ends of the connecting portion 22A are respectively connected to the two elongated arm portions 21A. One of the differences between the first configuration and the second configuration of the contact pad is that Each of the elongated arm portions 21A comprises a first end and a second end opposite each other and a middle section located between the first end and the second end, and the two ends of the connecting portion 22A are connected to the middle sections of the two elongated arm portions 21A. Therefore, in the second configuration, the contact pad 20A is H-shaped and comprises two non-enclosed openings 200A located in the H-shape. Precisely, one of the openings 200A is formed between the first ends of the two elongated arm portions 21A and the connecting portion 22A, and the other opening 200A is formed between the second ends of the two elongated arm portions 21A and the connecting portion 22A. In other words, the contact pad 20 comprises a H-shaped portion that is formed of two U-shaped portions.

Figure 6:
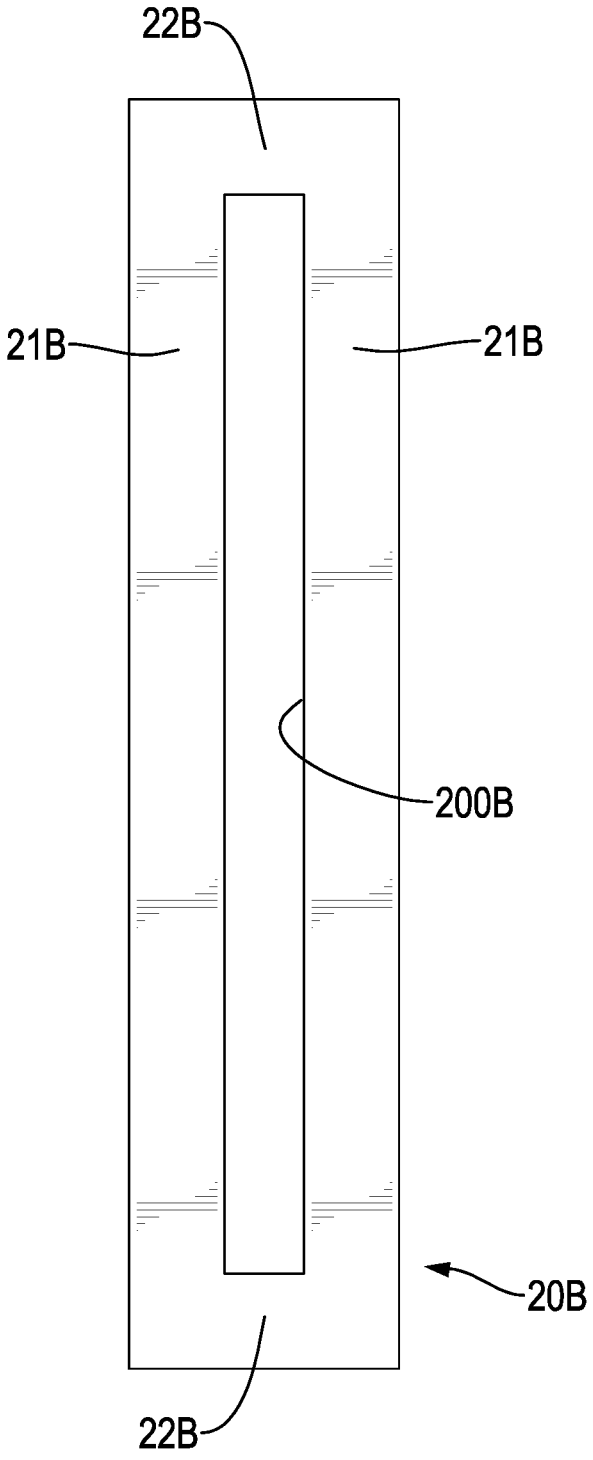
FIG. 6 is a schematic diagram of the contact pad in accordance with a third configuration of the circuit device in FIG. 1.

Then please refer to FIG. 6. In a third configuration of the contact pad 20B, it may include two elongated arm portions 21B and two connecting portions 22B. The two elongated arm portions 21B are spaced apart from each other and two connecting portions 22B are spaced apart from each other, too. Two ends of each connecting portion 22B are respectively connected to the two elongated arm portions 21B. Each of the elongated arm portions 21B comprises a first end and a second end opposite each other. The two ends of one of the connecting portions 22B are respectively connected to the first ends of the two elongated arm portions 21B and the two ends of the other connecting portion 22B are respectively connected to the second ends of the two elongated arm portions 21B. In other words, the contact pad 20B forms an enclosed loop or O-shape and has one enclosed opening 200B. Precisely, the two elongated arm portions 21B and the two connecting portions 22B enclose the opening 200B. In other words, the contact pad 20 comprises a O-shaped portion.

Figure 7:
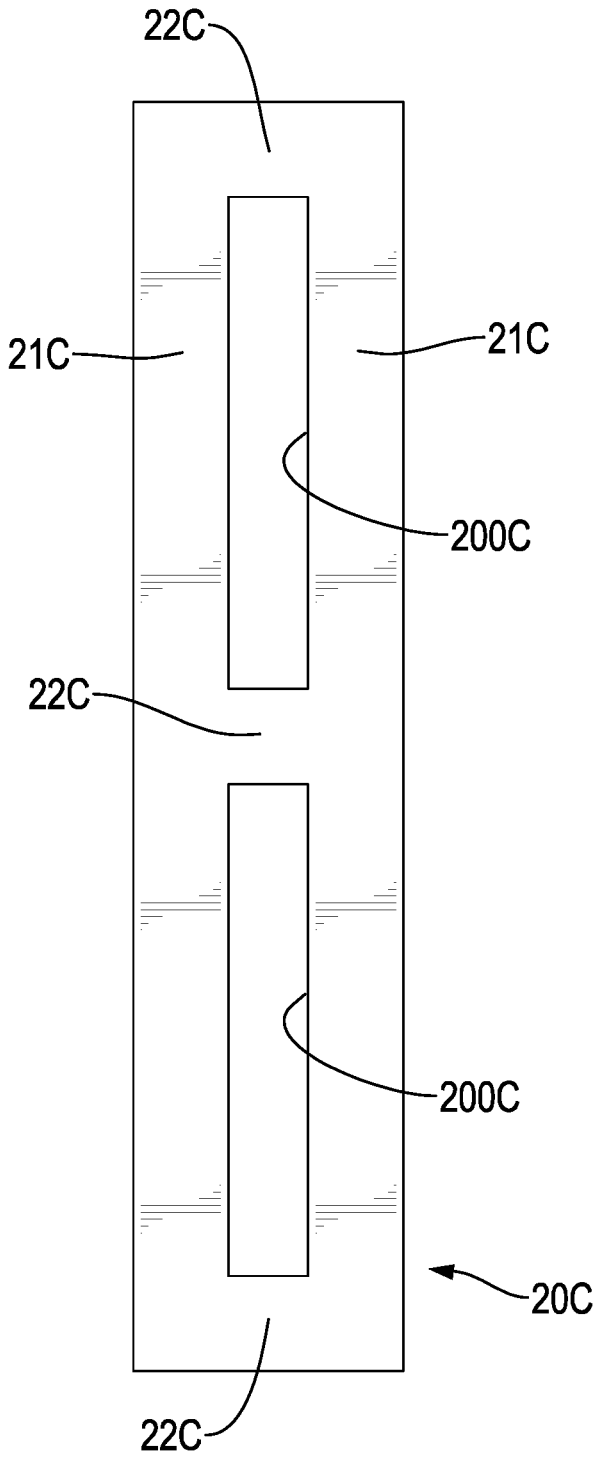
FIG. 7 is a schematic diagram of the contact pad in accordance with a fourth configuration of the circuit device in FIG. 1.

Then please refer to FIG. 7. In a fourth configuration of the contact pad 20C, it may include two elongated arm portions 21C and three connecting portions 22C. Two elongated arm portions 21C are spaced apart from each other and the three connecting portions 22C are spaced apart from each other, too. Two ends of the three connecting portions 22C are respectively connected to the two elongated arm portions 21C. Each of the elongated arm portions 21C comprises a first end and a second end opposite each other and a middle section located between the first end and the second end. The three connecting portions 22C may be defined as a first connecting portion 221C, a second connecting portion 222C, and a third connecting portion 223C, respectively. Two ends of the first connecting portion 221C are respectively connected to the first ends of the two elongated arm portions 21C, two ends of the second connecting portion 222C are respectively connected to the second ends of the two elongated arm portions 21C, and two ends of the third connecting portion 223C are respectively connected to the middle sections of the two elongated arm portions 21C. In other words, the contact pad 20C is 8-shaped and forms two enclosed openings 200C. The two elongated arm portions 21C and the adjacent two connecting portions 22C enclose one opening 200C. In other words, the contact pad 20 comprises an 8-shaped portion that is formed of two O-shaped portions.

Then please refer to FIG. 3 and FIGS. 8 to 10. In the present embodiment, the cable 30 comprises at least one wire 31 and each of the wires 31 is mounted on a respective one of the contact pads 20 with opening 200 or rectangular shaped pad and thereby electric connection is formed therebeween. Each of the wires 31 connected with the contact pad 20 with opening 200 covers at least part of or the whole opening 200 of the connected contact pad 20 and thus the interval 50 is formed in the opening 200, or say, the wire 31 covers at least part of the opening 200 and forms an air gap between the wire 31 and the circuit board 10. Precisely, the interval 50 is located in the opening 200 and between the circuit board 10 and the wire 31; meanwhile, at least part of the circuit board 10 is exposed via the opening 200 of the contact pad 21. The term exposed may be understood as "not covered". Moreover, the two elongated arm portions 21C are spaced apart from each other, so that the wire 31 is supported upon the circuit board 10 and the wire 21 indirectly contacts with the circuit board 10 via the pads and the wire has no direct contacts with the circuit board within the opening 200.

Each of the at least one wire has a section, or say, normal cross section, a shape of the section may be round, oval, ellipse, rectangle, or similar shape. In a preferred embodiment, a dimension of the section parallel with a width direction of the circuit board 10 is larger than a dimension of the section perpendicular to the width direction of the circuit board 10, or say, in simply, a width of the wire is larger than a thickness of the wire thereby preventing the wire from contacting the circuit board via the opening 200. Then please refer to FIG. 1, FIG. 8, and FIG. 11 again. The shield layer 40 surrounds and covers the whole rear end of the circuit board, including all pads formed thereon and wires connected thereto. More specifically, the shield layer 40 is mounted at a position where the wires 31 and the contact pads 20 are connected. Besides, the shield layer 40 may not exist in the interval 50. In other words, within the opening 200, the wire 31 and the circuit board 10 are spaced apart from each other and there may only be air in the interval 50. The shield layer 40 may include UV resin or other molding layer made from plastic materials.

In another embodiment, the shape of the contact pads 20 and the shape of the section of the wires 31 are not limited as disclosed above.

Moreover, as depicted by FIG. 2, the contact pads 20 with the opening 200 are separated by rectangular-shaped pads without opening, or say, at least one of the rectangular-shaped pads without opening is disposed between the two contact pads 20 with the opening 200. In another way, the circuit board 10 has a rear end (or say first end) and a front end (or say second end). A first pad row 20*f* is formed at the rear end of the circuit board 10, the first pad row 20*f* is consisted of a plurality of pads, the said plurality of pad comprises a plurality of rectangular shaped pads and a plurality of said contact pads 20 having the opening 200 respectively. A second pad row 20*g* is located at the front end of the circuit board 10 and consisted of a plurality of rectangular pads but without the contact pads 20 having the opening 200. Each of the pads in the first pad row 20*f* is connected with at least one wire. It is worth to mention that, as depicted by FIG. 2, the open end of all non-enclosed openings 200 may face toward the same direction opposite to the second pad row 20*g*. As depicted by FIG. 11, in practice, the rear end of the circuit board 10 and all pads located thereon, including the rectangular pads and the contact pads 20 with the opening 200, are all sealed within the shield layer 40 for protection.

With the aforementioned structure, the interval 50 (or say air gap) is formed within the opening 200 of each contact pad 20, the wire 31 and the circuit board 10 are spaced by the interval 50, and air is inside the interval 50. Thus, a capacitance is formed between the wire 31 and the circuit board 10. Precisely, a dielectric of said capacitance is air, and the dielectric coefficient is the lowest, so the capacitance value of said capacitance is the lowest and thereby the impedance value is the largest, which increases the maximum possible impedance value. Besides, the capacitance value and the impedance value can be changed not only via disposing different materials in the interval 50, but also via using different dimensions or areas of the contact pad 20 and the opening 200. For example, under the standard, the thickness of the contact pads 20, the widths of the elongated arm portions 21 or the connecting portion 22, the distance between the two elongated arm portions 21, and the number of the connecting portions 22 can be accustomed to further increase the maximum possible impedance value.

Moreover, sufficient contact area between the wire 31 and the contact pad 20 can be ensured by using a wire 31 having the width larger than the thickness thereof, which allows the wire 31 and the contact pad 20 can be firmly secured. Moreover, the portion of the wire 31 protrude into the opening 200 can also be minimized, which lowers the capacitance value a between the wire 31 and the circuit board 10 and thereby decreases the impedance value.

As a result, the terminal capacitance value and the impedance value may be controlled and determined at the manufacture process, providing more flexibility in design of the circuit device, and thus the circuit device may be suitable to 5G communications, artificial intelligence, edge computing, and Internet of things devices.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A circuit device comprising:

a circuit board;

at least one contact pad mounted on the circuit board and electrically connected with the circuit board; each contact pad comprises at least one opening; and at least one cable, comprising at least one wire respectively, the wire mounted on and electrically connected with the contact pad, the wire covering at least part of the opening of the contact pad thereby forming an air gap between the wire and the circuit board, the wire configured to transmit signals.

2. The circuit device as claimed in claim 1, wherein at least part of the circuit board is exposed via the at least two non-enclosed openings or the at least two enclosed openings of the contact pad.

3. The circuit device as claimed in claim 2, the contact pad comprising an H-shaped portion or an 8-shaped portion.

4. The circuit device as claimed in claim 1, wherein the at least one contact pad comprises a connecting portion and two elongated arm portions, two ends of the connecting portion are connected to the two elongated arm portions, the at least two non-enclosed openings or the at least two enclosed openings are formed between the two elongated arm portions and the connecting portion, and the two elongated arm portions are spaced apart from each other for supporting the wire of the at least one cable upon the circuit board, and the wire of the at least one cable has no direct contact with the circuit board within the at least two non-enclosed openings or the at least two enclosed openings.

5. The circuit device as claimed in claim 4, wherein the at least one contact pad is left-right symmetry.

6. The circuit device as claimed in claim 5, wherein the two elongated arm portions are rectangle-shaped respectively and are parallel to each other.

7. The circuit device as claimed in claim 1, wherein a width of the wire is larger than a thickness of the wire for preventing the wire from passing through the at least two non-enclosed openings or the at least two enclosed openings and contacting the circuit board.

8. The circuit device as claimed in claim 1, wherein a shape of a section of each one of the wire is an oval or a rectangle.

9. The circuit device as claimed in claim 1 further comprising a rectangular-shaped pad; wherein the at least one rectangular-shaped pad is disposed between two of the contact pads having the at least two non-enclosed openings or the at least two enclosed openings.

10. The circuit device as claimed in claim 9, wherein the circuit board has a first end and a second end, the first end has a first pad row consisting of a plurality of pads, the second end has a second pad row consisting of a plurality of pads, the first pad row is connected with the wire of the at least one cable, the first pad row comprises the at least one contact pad having the at least two non-enclosed openings or the at least two enclosed openings but the second pad row comprises zero of the contact pad having the at least two non-enclosed openings or the at least two enclosed openings.

11. The circuit device as claimed in claim 10 further comprising a shield layer covering the whole second end of the circuit board.

12. A connector, comprising at least one circuit device as claimed in claim 1.

13. A circuit device comprising:

a circuit board;

at least one contact pad mounted on the circuit board and electrically connected with the circuit board, the contact pad comprising at least one opening;

at least one cable, comprising a wire respectively, the wire being mounted on and electrically connected with the contact pad, the wire covering at least part of the opening of the contact pad for forming an air gap between the wire and the circuit board.

* * * * *